US009249659B2

(12) United States Patent
Pelletier

(10) Patent No.: US 9,249,659 B2
(45) Date of Patent: Feb. 2, 2016

(54) FORMATION FLUID PROPERTY DETERMINATION

(75) Inventor: Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 479 days.

(21) Appl. No.: 13/130,399

(22) PCT Filed: Apr. 15, 2009

(86) PCT No.: PCT/US2009/040611

§ 371 (c)(1),
(2), (4) Date: May 20, 2011

(87) PCT Pub. No.: WO2010/120285

PCT Pub. Date: Oct. 21, 2010

(65) Prior Publication Data

US 2011/0218736 A1 Sep. 8, 2011

(51) Int. Cl.

| | |
|---|---|
| ***G06F 19/00*** | (2011.01) |
| ***G01V 9/00*** | (2006.01) |
| ***E21B 49/08*** | (2006.01) |

(52) U.S. Cl.

CPC ..... *E21B 49/081* (2013.01); *E21B 2049/085* (2013.01)

(58) Field of Classification Search

CPC ..... E21B 49/008; E21B 49/081
See application file for complete search history.

(56) References Cited

U.S. PATENT DOCUMENTS

| | | | | |
|---|---|---|---|---|
| 5,263,322 | A | 11/1993 | Molini | |
| 5,612,493 | A * | 3/1997 | Alexander | 73/152.55 |
| 5,741,962 | A | 4/1998 | Birchak et al. | |
| 6,176,323 | B1 | 1/2001 | Weirich et al. | |
| 6,178,815 | B1 | 1/2001 | Felling et al. | |
| 6,234,250 | B1 * | 5/2001 | Green et al. | 166/250.03 |
| 6,758,090 | B2 | 7/2004 | Bostrom et al. | |
| 7,251,565 | B2 | 7/2007 | Storm, Jr. et al. | |
| 2002/0165670 | A1 * | 11/2002 | Ellis et al. | 702/8 |
| 2004/0104341 | A1 * | 6/2004 | Betancourt et al. | 250/255 |
| 2004/0231842 | A1 | 11/2004 | Shammai et al. | |

(Continued)

FOREIGN PATENT DOCUMENTS

| | | | |
|---|---|---|---|
| GB | 2453051 | A | 3/2009 |
| WO | WO-2010120285 | A1 | 10/2010 |

OTHER PUBLICATIONS

"International application serial No. PCT/US2009/040611 search report mailed Jun. 16, 2009".
"International application serial No. PCT/US2009/040611 Written Opinion mailed Jun. 16, 2009".

(Continued)

*Primary Examiner* — Patrick Assouad
*Assistant Examiner* — Haidong Zhang
(74) *Attorney, Agent, or Firm* — Schwegman Lundberg & Woessner, P.A.; Benjamin Fite

(57) ABSTRACT

In some embodiments, an apparatus and a system, as well as a method and an article, may operate to obtain a formation fluid sample from a formation adjacent to a wellbore disposed in a reservoir, determine the sample saturation pressure of the formation fluid sample, repeat obtaining the formation fluid sample and determining the sample saturation pressure over a selected time period or number of samples, and determine a predicted ultimate formation fluid saturation pressure based on multiple determinations of the sample saturation pressure. The sample saturation pressures measured over selected time periods can be used to determine fluid sample contamination. Additional apparatus, systems, and methods are disclosed.

26 Claims, 7 Drawing Sheets

(56) References Cited

U.S. PATENT DOCUMENTS

| | | | | |
|---|---|---|---|---|
| 2008/0017558 | A1 | 1/2008 | Pollock et al. | |
| 2008/0066537 | A1* | 3/2008 | Hegeman et al. | 73/152.28 |
| 2008/0189057 | A1* | 8/2008 | Perry et al. | 702/48 |
| 2009/0045974 | A1* | 2/2009 | Patel | 340/854.6 |
| 2009/0078036 | A1* | 3/2009 | Terabayashi et al. | 73/152.55 |

OTHER PUBLICATIONS

"International Application Serial No. PCT/US2009/40611,International Preliminary Report on Patentability mailed May 10, 2012", 4 pgs.

"European Application Serial No. 09843442.6, Extended European Search Report mailed Oct. 21, 2015", 8 pgs.

* cited by examiner

FORMATION FLUID PROPERTY DETERMINATION

This patent application is a nationalization under 35 U.S.C. 371 of PCT/US2009/040611, filed Apr. 15, 2009 and published as WO 2010/120285 A1 on Oct. 21, 2010; which application and publication are incorporated herein by reference in their entirety.

BACKGROUND

Sampling programs are often conducted in the oil field to reduce risk. For example, the more closely that a given sample of formation fluid represents actual conditions in the formation being studied, the lower the risk of error induced during further analysis of the sample. This being the case, bottom hole samples are usually preferred over surface samples, due to errors which accumulate during separation at the well site, remixing in the lab, and the differences in measuring instruments and techniques used to mix the fluids to a composition that represents the original reservoir fluid. However, downhole sampling can be costly in terms of time and money.

DETAILED DESCRIPTION

The current generation of formation evaluation tools draw fluid samples from formations through the mud cake of a well bore. This fluid is then transported through sensors within the tool, perhaps through a pump and/or another set of sensors, and finally past a sampling valve for capture. Many sensing methods are available to determine the fluid properties, including optical properties, physical properties (e.g., viscosity, density), nuclear magnetic resonance properties, etc. Using the various techniques presented herein, these properties can be used to predict when a sufficiently clean sample can been taken.

For example, a method of predicting fluid sample contamination may involve using one or more measured properties of the fluid, such as saturation pressure, which has a response to fluid composition that is substantially linear, or can be approximated as linear over a defined sampling interval. The selected fluid property can then be measured at a series of specific intervals, and the measured value of the property plotted as a function of the selected property. For example, in the case of saturation pressure, in effect, the measured saturation pressure can be plotted as a function of fluid composition in an arbitrary set of units. This provides an in-situ qualitative evaluation of fluid composition by measuring a fluid property that has a known linear or quasi-linear relationship to fluid composition.

Figure 1:
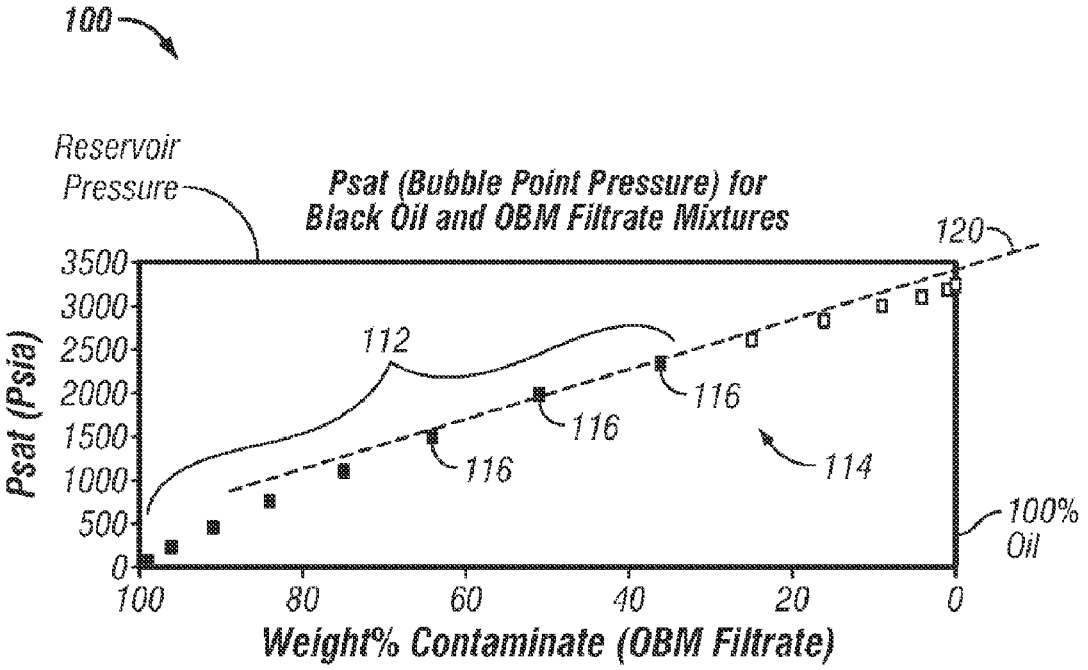
FIG. 1 illustrates reservoir fluid system behavior according to various embodiments of the invention.
Figure 1:
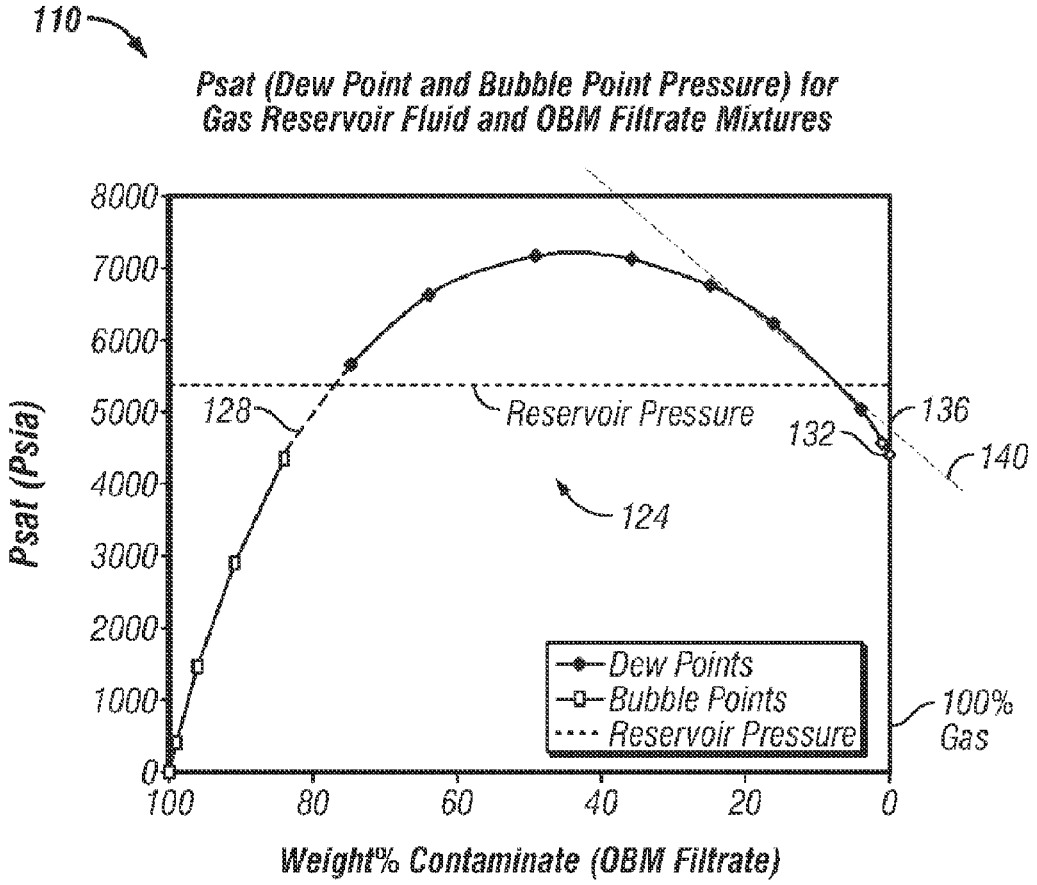

FIG. 1 illustrates reservoir fluid system 100, 110 behavior according to various embodiments of the invention. In the liquid phase fluid system 100, the saturation pressure of a time series 114 of reservoir fluid samples has been measured. Each sample 116 represents a known increment of pumped fluid volume. The saturation pressure may be determined in a number of ways, such as by reference to pressure-volume (PV) relationships, cavitation pressures, boiling points, speed of sound measurements, perturbation methods, and compositional measures, among others.

In this case the time series of the samples shows (for a single phase liquid) a progression from low or no detectable bubble point, to an increasing bubble point with each sample, to a final plateau (e.g., a maximum value, or a series of substantially unchanged maximal values). Initially, the bubble point value represents the vapor pressure of the drilling fluid. At the other extreme, the bubble point value represents what would be the directly-measured bubble point of the reservoir fluid, if such measurements are taken.

The fluid sequence entering a formation evaluation tool follows a similar behavioral path in terms of concentrations and physical properties. As formation fluid continues to be pumped through the tool, the appearance in time of discrete compositional ratios is determined by many parameters, such as: rock properties, including permeability, porosity, surface chemistry, mineralogy, morphology, saturation phase, and saturation history; reservoir fluid phase and properties, including composition temperature pressure, viscosity, and density; filtrate physical properties (e.g., viscosity, density, phase (oil/water/gas)), filter cake thickness, and time in contact with the reservoir and reservoir fluids; and tool properties, including probe style, pumping speed, and differential pressure and efficiency.

For a fluid system, a few saturation pressure measurements (e.g., perhaps as little as two or three) may be sufficient to permit extrapolation to the condition where 0% contaminant exists. This is because the endpoint saturation pressure is less than the reservoir pressure in a fluid system. Thus, for the system 100, the substantially linear relationship of the samples 112 allows a line 120 to be fitted to the ultimate samples 116 to indicate an ultimate saturation pressure of approximately 3450 Psia. This value, which is less than (a measured) reservoir pressure of 3500 Psia, verifies extrapolating the saturation pressure measured in conjunction with the final three samples 116 to a predicted ultimate saturation pressure of 3450 Psia.

The predicted ultimate saturation pressure for the formation fluid can be used for contamination correlation. This process involves determining the fully saturated property for a reservoir fluid with a fixed gas content, where liquids increase as filtrate is mixed into the sample. For example, the reservoir fluid may comprise a liquid that is miscible with mud filtrate, such as Oil Based Mud (OBM) or Synthetic Oil Based Mud (Syn-OBM).

For a mixed phase fluid system 110, such as where the reservoir fluid comprises gas, and the fluid is miscible with mud filtrate, the phase behavior of the mixed fluids is more complicated. Here the saturation pressure property includes a time series 124 progression that begins with the vapor pressure of the drilling fluid filtrate characterized by an increasing bubble point, and then a discontinuity 128 that joins with a two phase system at reservoir pressure (with subsequent saturation pressure points potentially higher than the reservoir pressure). Samples later in the series 124 should see a bubble point behavior change to a dew point phase behavior which finally stabilizes at the dew point of the reservoir fluid 132.

In circumstances where the reservoir fluid comprises a dry gas, the saturation pressure progression begins at the vapor pressure of the filtrate, and moves on to a bubble point fluid behavior. A dew point fluid behavior is then entered, eventually coinciding with that of a "permanent gas", perhaps exceeding the pressure and volume capabilities of the tool system. These progressions are also substantially mirrored by fluids withdrawn into a formation evaluation tool. Thus, in these cases also, after some time of sampling, the endpoint saturation pressure 136 can be extrapolated on the far side of the saturation pressure curve, after the dew point phase behavior is reached. A line 140 can be fitted to the series 124 to find the extrapolated ultimate predicted formation fluid saturation pressure in this case as well.

A supplemental approach involves the use of other sensors to estimate contamination. For example, the density of the fluid versus saturation pressure, and differentials thereof, can lead to an extrapolation of the reservoir contamination at a time of "infinite pumping", or substantially constant density.

Thus, once it is acquired, the sample data can be used to predict the quality of the final flowing fluid in the tool to initiate a sample capture in a chamber for further analysis at the surface. The data can be used in conjunction with a correlation function that has "basin knowledge concerning the possible reservoir fluids and current best guesses of PVT properties" to act as general fluid property data base to constrain the range of possible solutions. The difference between the extrapolated saturation pressure and the measured saturation pressure results in a prediction of the contamination for captured samples.

If all samples are taken after significant fluid pumping (i.e., until the measured saturation pressure is about the same as the ultimate predicted formation fluid saturation pressure), it is possible to sample the reservoir fluid only. This special case then can be used to measure the repeatability of the instrument within the tool. This is an indication of either 100% reservoir fluid, a steady state leak at the pad interface, or a constant rate of filtrate influx. In such cases, at a chosen depth station and set, the sample quality will not substantially improve.

Figure 2:
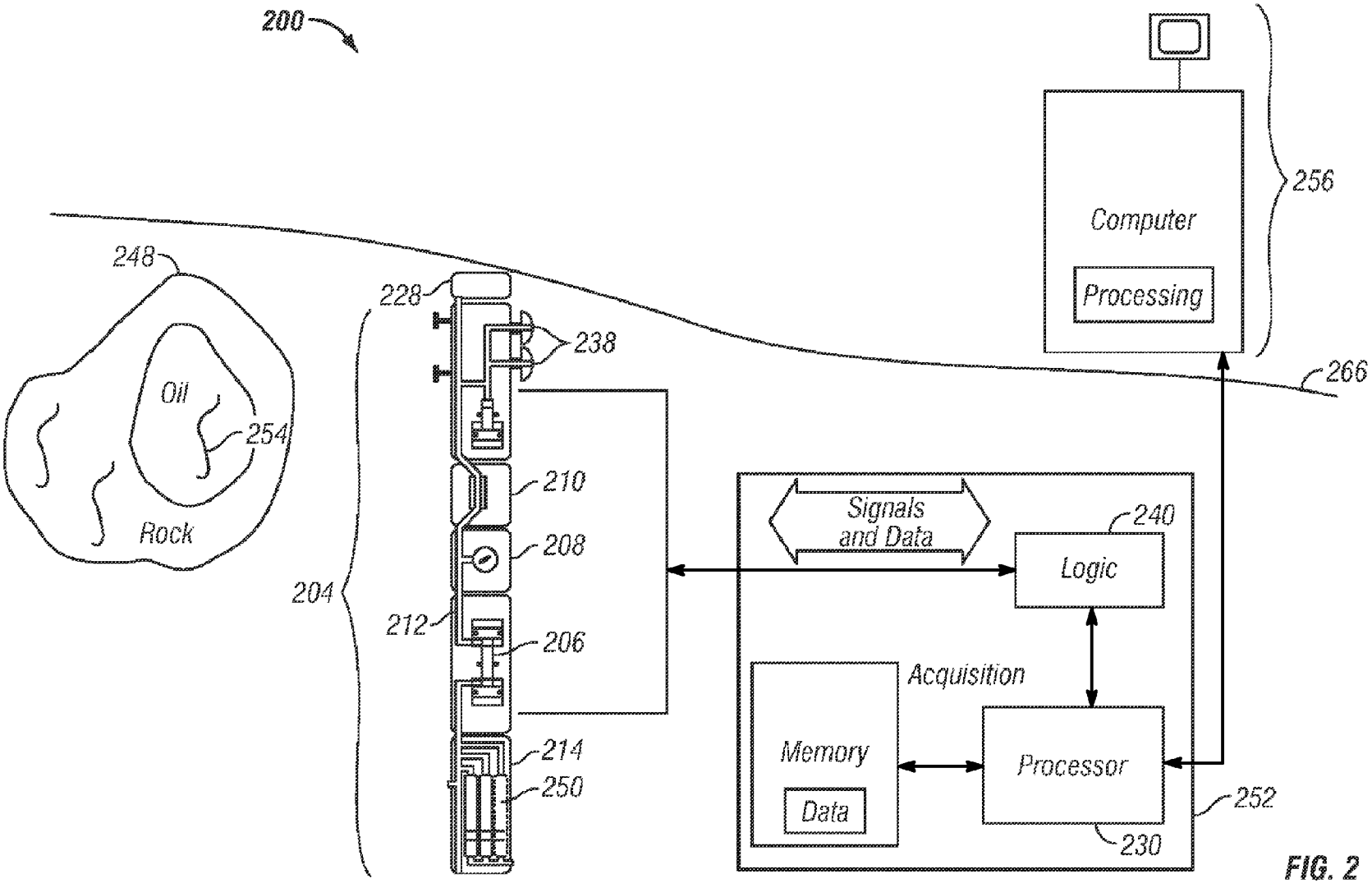
FIG. 2 is a block diagram of an apparatus according to various embodiments of the invention.

FIG. 2 is a block diagram of an apparatus 200 according to various embodiments of the invention. The apparatus 200 includes a downhole tool 202 (e.g., a pumped formation evaluation tool) comprising a fluid sampling device 204, which in turn includes a pressure measurement device 208 (e.g., pressure gauge, pressure transducer, strain gauge, etc.). The device 204, and any of its components, may be physically rotatable about an azimuthal axis 112 passing through an attachment assembly 228.

The downhole tool 202 may comprise one or more probes 238 to touch the formation 248 and to extract fluid from the formation 248. The tool also comprises at least one fluid path 212 that includes a pump 206. A sampling sub 214 (e.g., multi-chamber section) with the ability to individually select a fluid storage module 250 to which a fluid sample can be driven may exist between the pump 206 and the fluid exit from the tool 202. The pressure measurement device 208 and/or sensor section 210 may be located in the fluid path 212 so that saturation pressure can be measured while fluid is pumped through the tool 202. It should be noted that, while the downhole tool 202 is shown as such, some embodiments of the invention may be implemented using a wireline logging tool body that includes the fluid sampling device 204. However, for reasons of clarity and economy, and so as not to obscure the various embodiments illustrated, this implementation has not been explicitly shown.

The attachment assembly 228 may comprise drill pipe or a pressurized container having walls of varying thickness and/or recesses to attach to or contain one or more pressure measurement devices 208. The apparatus 200 may also include logic 240, perhaps comprising a programmable drive and/or sampling control system. The logic 240 can be used to actuate motors to rotate the assembly 228 about the azimuthal axis 212 and/or to acquire formation fluid property data, such as saturation pressure.

The apparatus 200 may include a data acquisition system 252 to couple to the sampling device 204 and to receive signals generated by the pressure measurement device 208. The data acquisition system 252, and any of its components, may be located downhole, perhaps in a tool housing, or at the surface 266, perhaps as part of a computer workstation 256 in a surface logging facility.

In some embodiments of the invention, the downhole apparatus 200 can operate to perform the functions of the workstation 256, and these results can be transmitted up hole or used to directly control the downhole sampling system. For example, when it is determined that the fluid being withdrawn from the formation 248 is substantially uncontaminated then a sample can be taken and the process of sampling can be ended for that location.

Thus, in some embodiments, an apparatus 200 may comprise a fluid sampling device 204 (e.g., the probes 238 and/or the pump 206) to obtain a plurality of formation fluid samples 254 that can be stored in the fluid storage modules 250 from a formation 248 adjacent to a wellbore. The apparatus 200 may also comprise a pressure measurement device 208 to measure the sample saturation pressure of one or more formation fluid samples 254 that can be stored in the fluid storage modules 250. A processor 230 in the apparatus 200 may be used to determine a predicted ultimate formation fluid saturation pressure based on multiple measurements of the sample saturation pressure.

The sensor section 210 may comprise one or more sensors, such as a bubble point sensor to provide a bubble point of the formation fluid samples 254. Additional sensor types that may be included in the sensor section 210 are: a compressibility sensor to provide compressibility of the formation fluid samples 254, a speed of sound sensor to provide the speed of sound in the formation fluid samples 254, an ultrasonic transducer to provide a cavitation pressure of the formation fluid samples 254, a viscosity sensor to provide the viscosity of the formation fluid samples 254, and/or an optical density sensor to provide the optical density of the formation fluid samples 254.

In some embodiments, the apparatus 200 may include a bulk density sensor as part of the sensor section 210 to provide a bulk density measurement that is correlated with the sample saturation pressure to verify the predicted ultimate formation fluid saturation pressure. Similarly, the apparatus 200 may include a viscosity sensor as part of the sensor section 210 to provide a viscosity measurement that is correlated with the sample saturation pressure, also to verify the predicted ultimate formation fluid saturation pressure.

For example, to address the case of using viscosity to verify the predicted ultimate formation fluid saturation pressure, the reader may consider that as the pressure is reduced, the viscosity should be substantially a linear function of pressure in a liquid system, such that lower pressures correlate to lower viscosity. At the bubble point, the liquid viscosity changes behavior, and the pressure viscosity behavior becomes an exponential curve where the highest value occurs at roughly the lowest pressure. The situation is similar for a gas system, but the continuous curve is one of the gas viscosity. Contamination may be predicted as percent by weight, volume percent, or even mole percent (all of which are convertible between themselves).

Figure 3:
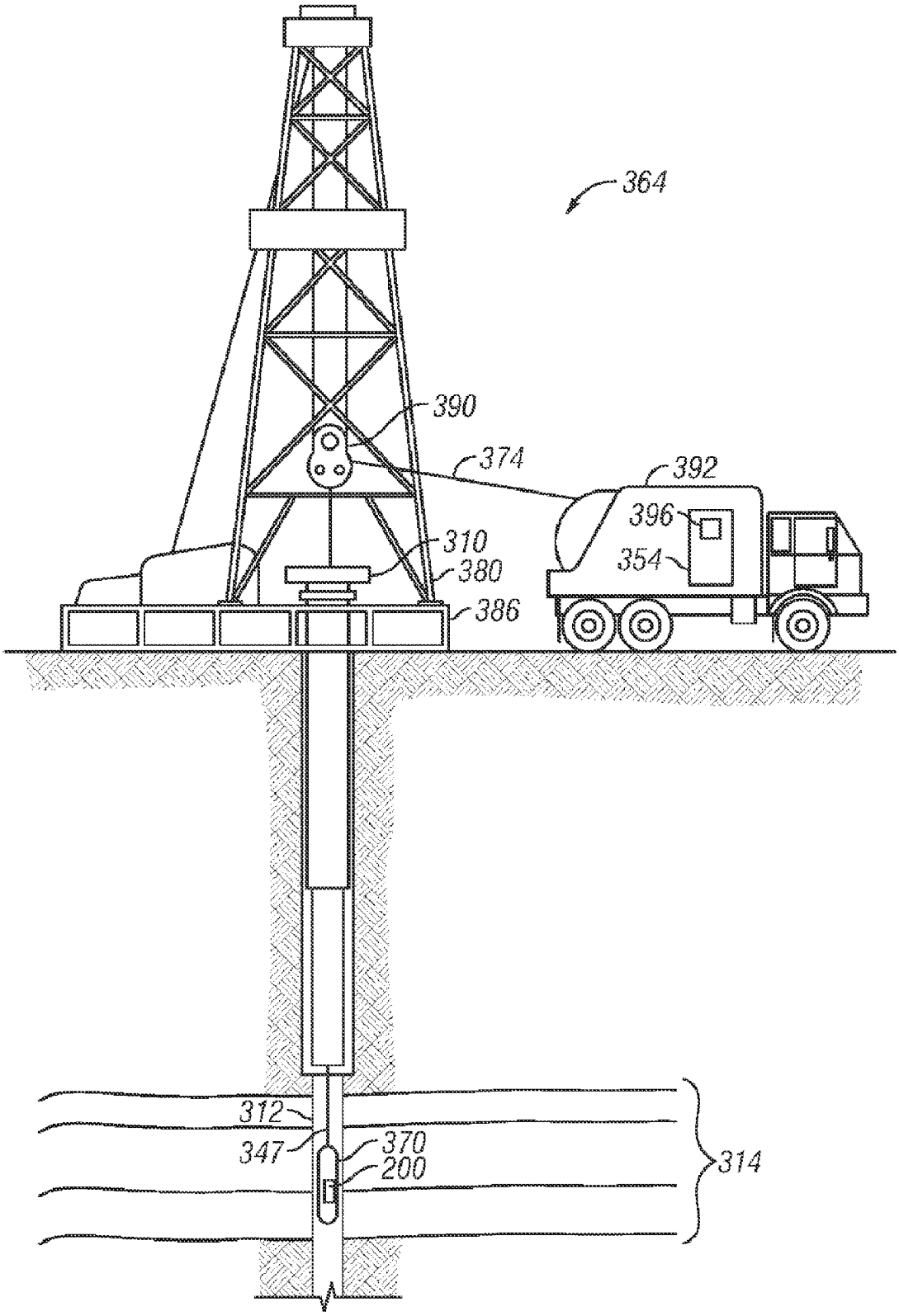
FIG. 3 illustrates a wireline system embodiment of the invention.
Figure 4:
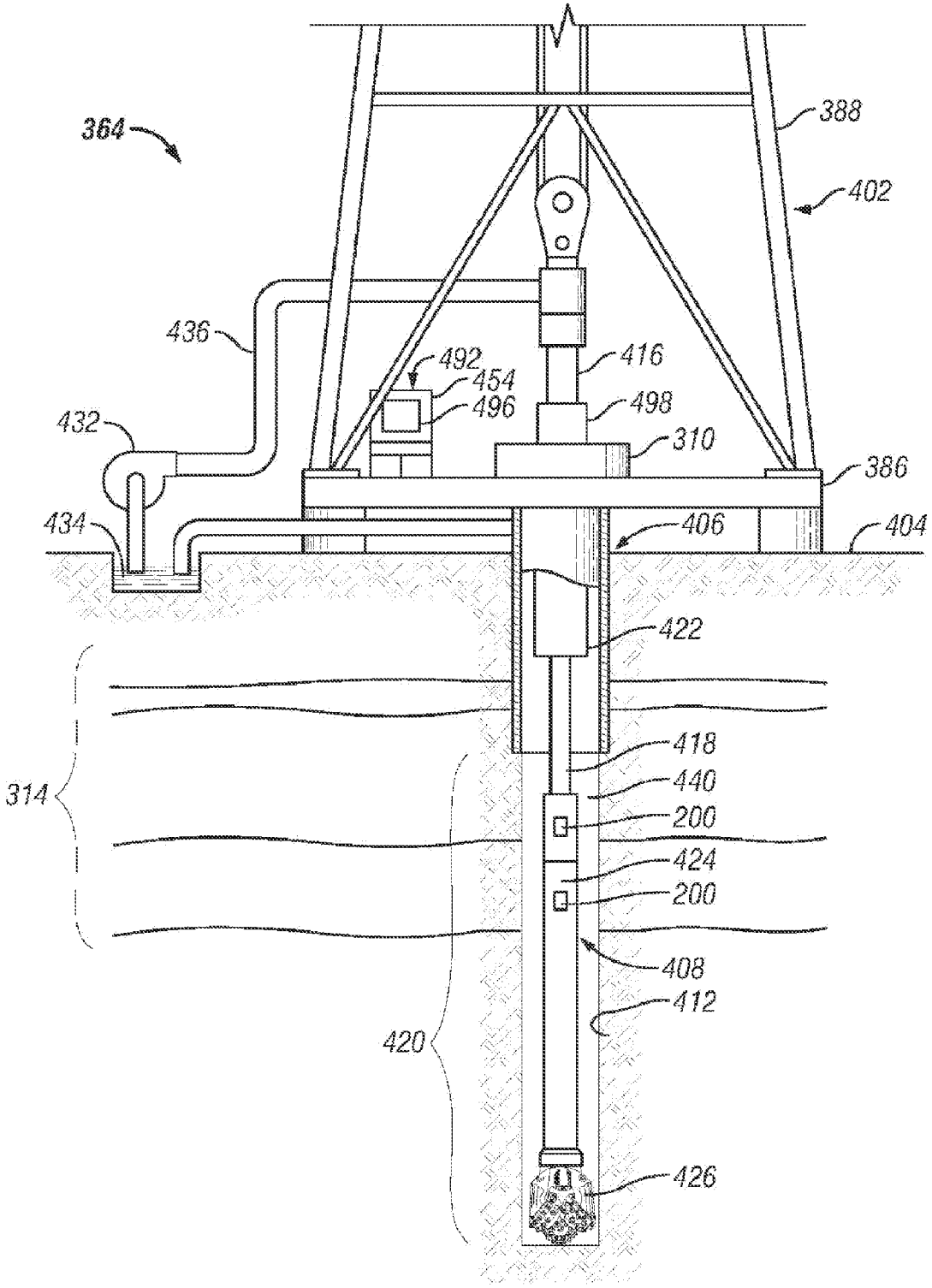
FIG. 4 illustrates a drilling rig system embodiment of the invention.

FIG. 3 illustrates a wireline system 364 embodiment of the invention, and FIG. 4 illustrates a drilling rig system 364 embodiment of the invention. Thus, the systems 364 may comprise portions of a tool body 370 as part of a wireline logging operation, or of a downhole tool 424 as part of a downhole drilling operation. FIG. 3 shows a well during wireline logging operations. A drilling platform 386 is equipped with a derrick 388 that supports a hoist 390.

Drilling of oil and gas wells is commonly carried out using a string of drill pipes connected together so as to form a drilling string that is lowered through a rotary table 310 into a wellbore or borehole 312. Here it is assumed that the drilling string has been temporarily removed from the borehole 312 to allow a wireline logging tool body 370, such as a probe or sonde, to be lowered by wireline or logging cable 374 into the borehole 312. Typically, the tool body 370 is lowered to the bottom of the region of interest and subsequently pulled upward at a substantially constant speed.

During the upward trip, at a series of depths the tool movement can be paused and the tool set to pump fluids into the instruments (e.g., the sampling device 204, the sensor section 210, and the pressure measurement device 208 shown in FIG. 2) included in the tool body 370 may be used to perform measurements on the subsurface geological formations 314 adjacent the borehole 312 (and the tool body 370). The measurement data can be communicated to a surface logging facility 392 for storage, processing, and analysis. The logging facility 392 may be provided with electronic equipment for various types of signal processing, which may be implemented by any one or more of the components of the apparatus 200 in FIG. 2. Similar formation evaluation data may be gathered and analyzed during drilling operations (e.g., during logging while drilling (LWD) operations, and by extension, sampling while drilling).

In some embodiments, the tool body 370 comprises a formation testing tool for obtaining and analyzing a fluid sample from a subterranean formation through a wellbore. The formation testing tool is suspended in the wellbore by a wireline cable 374 that connects the tool to a surface control unit (e.g., comprising a workstation 354). The formation testing tool may be deployed in the wellbore on coiled tubing, jointed drill pipe, hard wired drill pipe, or any other suitable deployment technique.

As is known to those of ordinary skill in the art, the formation testing tool may comprise an elongated, cylindrical body having a control module, a fluid acquisition module, and fluid storage modules. The fluid acquisition module may comprise an extendable fluid admitting probe and extendable tool anchors. Fluid can be drawn into the tool through one or more probes by a fluid pumping unit. The acquired fluid then flows through one or more fluid measurement modules (e.g., elements 208 and 210 in FIG. 2) so that the fluid can be analyzed using the techniques described herein. Resulting data can be sent to the workstation 354 via the wireline cable 374. The fluid that has been sampled can be stored in the fluid storage modules (e.g., elements 250 in FIG. 2) and retrieved at the surface for further analysis.

Turning now to FIG. 4, it can be seen how a system 364 may also form a portion of a drilling rig 402 located at the surface 404 of a well 406. The drilling rig 402 may provide support for a drill string 408. The drill string 408 may operate to penetrate a rotary table 310 for drilling a borehole 312 through subsurface formations 314. The drill string 408 may include a Kelly 416, drill pipe 418, and a bottom hole assembly 420, perhaps located at the lower portion of the drill pipe 418.

The bottom hole assembly 420 may include drill collars 422, a downhole tool 424, and a drill bit 426. The drill bit 426 may operate to create a borehole 312 by penetrating the surface 404 and subsurface formations 314. The downhole tool 424 may comprise any of a number of different types of tools including MWD (measurement while drilling) tools, LWD tools, and others.

During drilling operations, the drill string 408 (perhaps including the Kelly 416, the drill pipe 418, and the bottom hole assembly 420) may be rotated by the rotary table 310. In addition to, or alternatively, the bottom hole assembly 420 may also be rotated by a motor (e.g., a mud motor) that is located downhole. The drill collars 422 may be used to add weight to the drill bit 426. The drill collars 422 may also operate to stiffen the bottom hole assembly 420, allowing the bottom hole assembly 420 to transfer the added weight to the drill bit 426, and in turn, to assist the drill bit 426 in penetrating the surface 404 and subsurface formations 314.

During drilling operations, a mud pump 432 may pump drilling fluid (sometimes known by those of skill in the art as "drilling mud") from a mud pit 434 through a hose 436 into the drill pipe 418 and down to the drill bit 426. The drilling fluid can flow out from the drill bit 426 and be returned to the surface 404 through an annular area 440 between the drill pipe 418 and the sides of the borehole 312. The drilling fluid may then be returned to the mud pit 434, where such fluid is filtered. In some embodiments, the drilling fluid can be used to cool the drill bit 426, as well as to provide lubrication for the drill bit 426 during drilling operations. Additionally, the drilling fluid may be used to remove subsurface formation 314 cuttings created by operating the drill bit 426.

Thus, referring now to FIGS. 2-4, it may be seen that in some embodiments, the system 364 may include a drill collar 422, a downhole tool 424, and/or a wireline logging tool body 370 to house one or more apparatus 200, similar to or identical to the apparatus 200 described above and illustrated in FIG. 2. Thus, for the purposes of this document, the term "housing" may include any one or more of a drill collar 422, a downhole tool 202, 424, and a wireline logging tool body 370 (all having an outer wall, such as is included in the attachment assembly 228 of FIG. 2, to enclose or attach to instrumentation, sensors, fluid sampling devices, pressure measurement devices, and data acquisition systems). The downhole tool 202, 424 may comprise an LWD tool or MWD tool. The tool body 370 may comprise a wireline logging tool, including a probe or sonde, for example, coupled to a logging cable 374. Many embodiments may be realized.

For example, in some embodiments, a system 364 may include a display 396 to present saturation pressure information, both measured and predicted, as well as contaminant information (both measured and predicted), perhaps in graphic form. A system 364 may also include computation logic, perhaps as part of a surface logging facility 392, or a computer workstation 354, to receive signals from fluid sampling devices, pressure measurement devices, and other instrumentation to determine measured and predicted values for formation fluid saturation pressure, as well as contamination.

Thus, a system 364 may comprise a downhole tool 202, 424, and one or more apparatus 200 at least partially housed by the downhole tool 202, 424. The apparatus 200 is used to provide a predicted ultimate saturation pressure of a formation fluid sample, and comprises a fluid sampling device, a pressure measurement device, and a processor, as described previously. The downhole tool 202, 424 may comprise a wireline tool or an MWD tool. In some embodiments, the system 364 may comprise a bulk density sensor and/or viscosity sensor that provide measurements to correlate with the sampled saturation pressures and to verify the predicted ultimate formation fluid saturation pressure, as described previously.

The apparatus 200; downhole tool 202, 424; fluid sampling device 204; pressure measurement device 208; sensor section 210; fluid path 212; attachment assembly 228; processor 230; logic 240; data acquisition system 252; computer workstations 256, 354; systems 364; tool body 370; logging cable 374; drilling platform 386; derrick 388; hoist 390; logging facility 392; display 396; drilling rig 302; surface 404; well 406; drill string 408; rotary table 310; borehole 312; Kelly 416; drill pipe 418; bottom hole assembly 420; drill collars 422; drill bit 426; mud pump 432; mud pit 434; hose 436; and annular area 440 may all be characterized as "modules" herein. Such modules may include hardware circuitry, and/or a processor and/or memory circuits, software program modules and objects, and/or firmware, and combinations thereof, as desired by the architect of the apparatus 200 and systems 364, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus 200 and systems 364 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules. Such apparatus and systems may further be included as subcomponents within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 5:
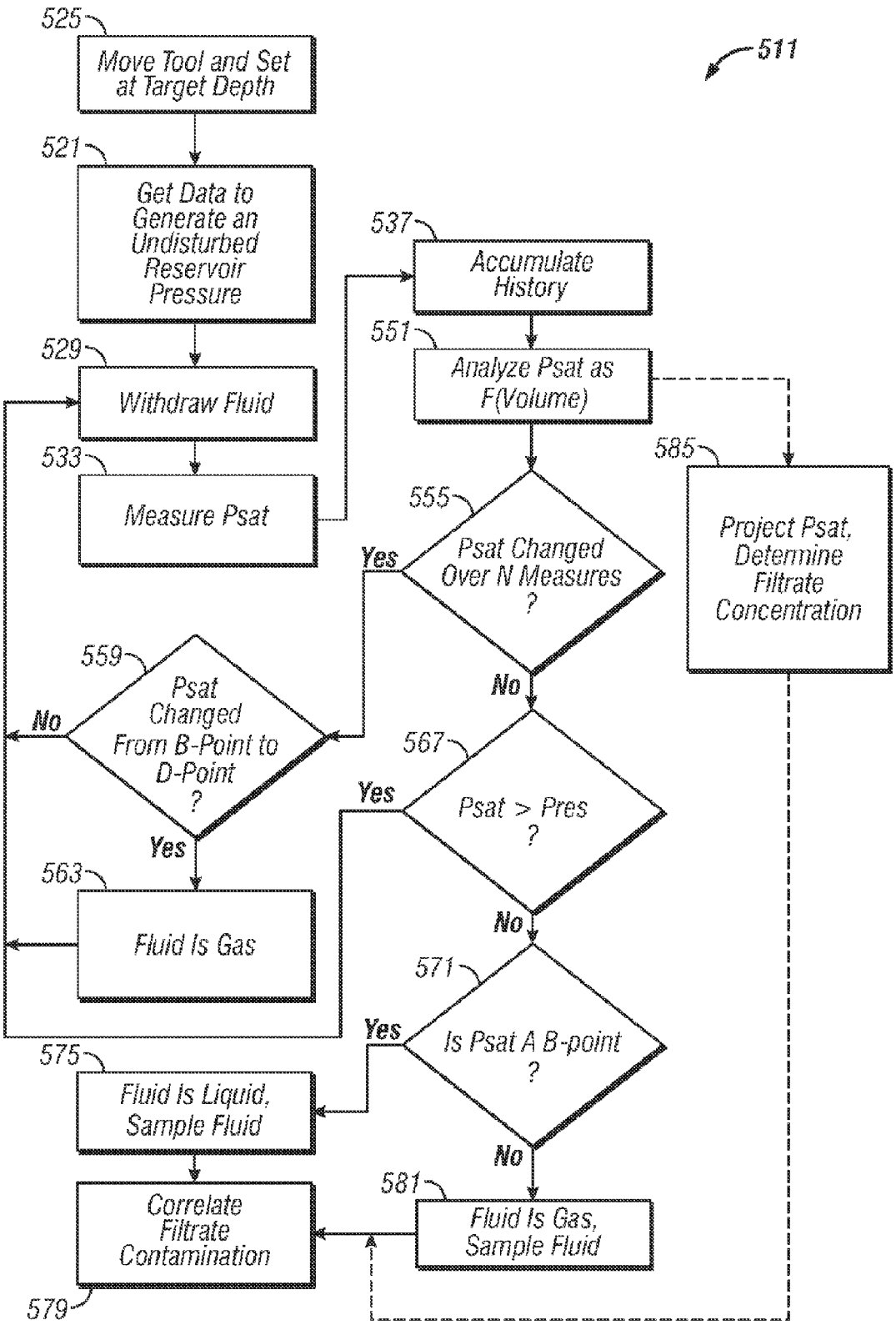
FIG. 5 is a flow chart illustrating several methods according to various embodiments of the invention.

For example, FIG. 5 is a flow chart illustrating several methods according to various embodiments of the invention. Thus, a method 511 of determining filtrate contamination may begin at block 521 with moving the tool to a selected target depth. The method 511 may continue on to block 525 with obtaining a series of pressure versus depth data points to determine an undisturbed reservoir pressure, and/or an appropriate target sampling interval and pressure gradient (e.g., in kilograms per square centimeter, per meter).

The method 511 may then go on to block 529 to include withdrawing fluid from the reservoir, perhaps at a substantially steady rate, and then on to block 533 with measuring the saturation pressure of the fluid sample.

At block 537, the method 511 may include accumulating fluid sample saturation pressure history over time (e.g., over several measurements at the same target depth). The method 511 may continue on to block 551 with analyzing the saturation pressure as a function of volume withdrawn from the formation.

At block 555, a determination is made as to whether the saturation pressure has changed over the last N measurements, where N is a selectable number of measurements (e.g., N=3) that can be incremented (e.g., N=N+1) after each measurement. Incrementing in this way operates to develop a history of saturation pressure versus the total pumped volume. The number of measurements N can be determined by time constraints, equipment constraints, economic constraints, and/or accuracy constraints.

If the measured saturation pressure has changed over N measurements, then the method 511 may go on to include, at block 559, determining whether the saturation pressure has changed from a bubble point to a dew point. At this point, if the saturation pressure has changed from the bubble point to the dew point, as determined at block 559, then the method 511 may include returning to block 529, to withdraw more fluid.

If the saturation pressure has changed from the bubble point to the dew point, as determined at block 559, then the method 511 may go on to block 563 where the fluid can be designated as a gas, and it is then known that the ultimate saturation pressure is equal to or less than the reservoir pressure after declining values of the saturation pressure have been measured. Once this occurs, the method 511 may continue on to block 529 to withdraw additional fluid as a fresh sample.

If it is determined that the saturation pressure has not changed substantially over the last N measurements at block 555, then the method 511 may go on to block 567 to include determining whether the saturation pressure is greater than the reservoir pressure. If so, then the method 511 may continue on to block 529, to withdraw more fluid. The comparison at block 567 can also be made each time N is incremented (e.g., N=N+1).

If the saturation pressure is determined not to be greater than the reservoir pressure at block 567, then the method 511 may include determining whether the saturation pressure is a bubble point at block 571. If so, then the fluid may be designated as a liquid, and the activity at block 575 may include sampling the reservoir fluid. The method 511 may then include the activity at block 579, which comprises using the variation in saturation pressure history to correlate a drilling fluid filtrate contamination. While theoretically pumping "forever" would result in obtaining pure fluid, economic constraints determine when the sample is clean enough to use. Projections are based on a saturation pressure estimate that indicates the fluid contamination level after an additional number of samples.

If it is determined that the saturation pressure is not a bubble point at block 571, then the method may include designating the fluid as a gas at block 581, and sampling the reservoir fluid. The method 511 may then go on to block 579.

The saturation pressure and/or contamination may also be predicted, as noted previously. Thus, after the activity of block 551, the method 511 may continue on to block 585 with projecting or predicting the withdrawn volume versus saturation pressure. That is, the formation fluid saturation pressure may be predicted at an "infinite volume withdrawn", with different models used for single phase fluid systems, and multi-phase fluid systems. The drilling fluid filtrate concentration or contamination can then be determined. Still further embodiments may be realized.

Figure 6:
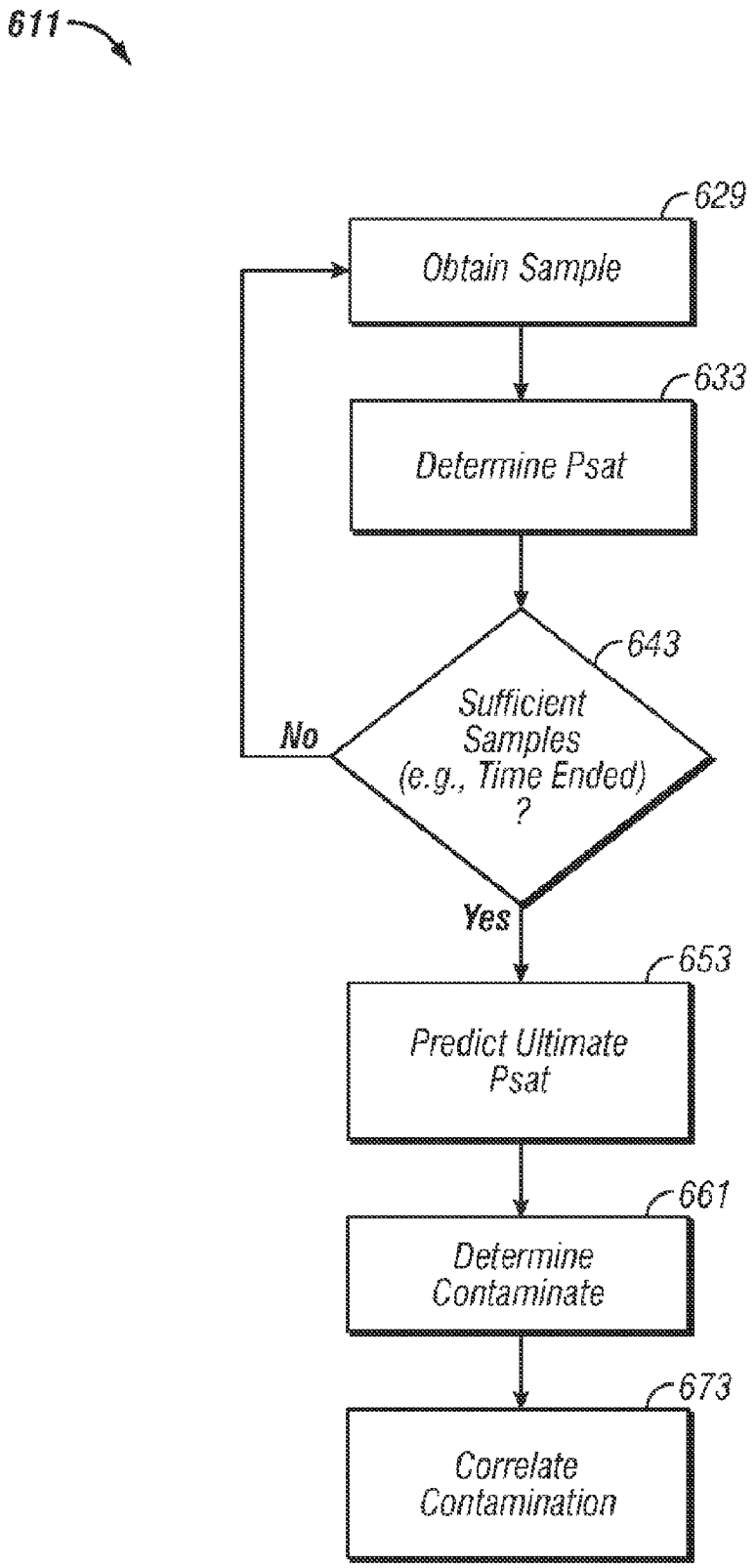
FIG. 6 is a flow chart illustrating several additional methods according to various embodiments of the invention.

For example, FIG. 6 is a flow chart illustrating several additional methods 611 according to various embodiments of the invention. In some embodiments, a method 611 may begin at block 629 with obtaining a formation fluid sample from a formation adjacent to a wellbore disposed in a reservoir.

The method 611 may continue on to block 633 with determining a sample saturation pressure for the formation fluid sample. Determining the sample saturation pressure at block 633 may comprise determining a bubble point of the formation fluid sample, and deriving the sample saturation pressure from the bubble point.

The bubble point may be determined as an inflection point of repeated measurements of compressibility of the formation fluid sample (e.g., when a compressibility sensor is used). Other mechanisms to determine the bubble point in the formation fluid sample include: determining the bubble point as a discontinuity in repeated measurements of the speed of sound in the sample, or as an ultrasonic cavitation pressure of the sample, or as a discontinuity in repeated measurements of viscosity of the sample.

The method 611 may go on to block 643 to include repeatedly obtaining a formation fluid sample and determining the sample saturation pressure over a selected time period, or over some number of samples. Repeatedly obtaining the formation fluid sample and determining the sample saturation pressure may comprise obtaining subsequent formation fluid samples when the sample saturation pressure is greater than the reservoir pressure, and determining the sample saturation pressure of the subsequent formation fluid samples. In this way, the method 611 includes continuing to determine the saturation pressure even when measuring the dew point, rather than the bubble point.

After terminating the repetition loop of blocks 629, 633, and 643, the method 611 may go on to block 653 to include determining a predicted ultimate formation fluid saturation pressure based on multiple determinations of the sample saturation pressure. Thus, as noted previously, some methods 611 may comprise obtaining a fluid sample, determining the sample saturation pressure, and repeating these activities until a calculation to predict the ultimate formation fluid saturation pressure can be made.

Determining the predicted ultimate formation fluid saturation pressure at block 653 may comprise determining the predicted ultimate formation fluid saturation pressure based on a substantially unchanged value of the sample saturation pressure. Whether the value is substantially unchanged can be determined by the measurement capabilities of the instrument.

For example, a value that lies within three times the measurement uncertainty (e.g., three times the standard deviation of the instrument measurement uncertainty) can be considered as "substantially unchanged". Another measure of whether the value is substantially unchanged is when the slope of the determined percent contamination with respect to time is less then |0.1|.

The predicted ultimate formation fluid saturation pressure may also be determined based on a prediction that the subsequent values of the sample saturation pressure are likely to be less than or equal to a pressure of the reservoir. This was demonstrated in the case of the single phase liquid fluid behavior, as well as the mixed phase fluid behavior shown in FIG. 1.

A time series of samples can thus be extracted from the flow line of a tool during controlled pumping, with each sample being isolated from the flow stream and expanded to measure saturation pressure. At some pressure value the behavior of the system changes. This change can be detected using volume and pressure measures, or any of a number of sensors, such as density meters, optical spectrometers, viscometers etc.

In the density meter case, the density of the in-flowing fluid compared to the density of the fluid at the saturation pressure are plotted against the volume between measured samples to generate a history. The trend of the history over increasing time can be extrapolated to predict the "uncontaminated" value of the saturation pressure density. The difference between the densities can be represented as a current percent contamination and a time to achieve sufficient purity, or at least a time and condition where the last sample and the "ultimate sample density" are substantially indistinguishable.

The method 611 may then go on to block 661 with determining a contaminant percent-by-weight or volume of the formation fluid sample based on the sample saturation pressure. The activity at block 661 may include determining a predicted percent-by-weight contamination percentage of the formation fluid sample as a substantially linear approximation of at least three serial measurements of the sample saturation pressure, as shown in FIG. 1.

The method 611 may go on to block 673 with correlating the sample saturation pressure with another measurement, such as a viscosity measurement, to verify the predicted ultimate formation fluid saturation pressure. The activity at block 673 may also include correlating the sample saturation pressure and differentials of the sample saturation pressure with another measurement, such as the density of the formation fluid sample, to verify the predicted ultimate formation fluid saturation pressure. Thus, the method 611 may include terminating the repetition of blocks 629, 633, and 643 to perform contaminant correlation analysis of the formation fluid sample after the predicted ultimate formation fluid saturation pressure is determined at block 653.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well known to those skilled in the art, such as application program interfaces or interprocess communication techniques, including remote procedure calls. The teachings of various embodiments are not limited to any particular programming language or environment. Thus, other embodiments may be realized.

Figure 7:
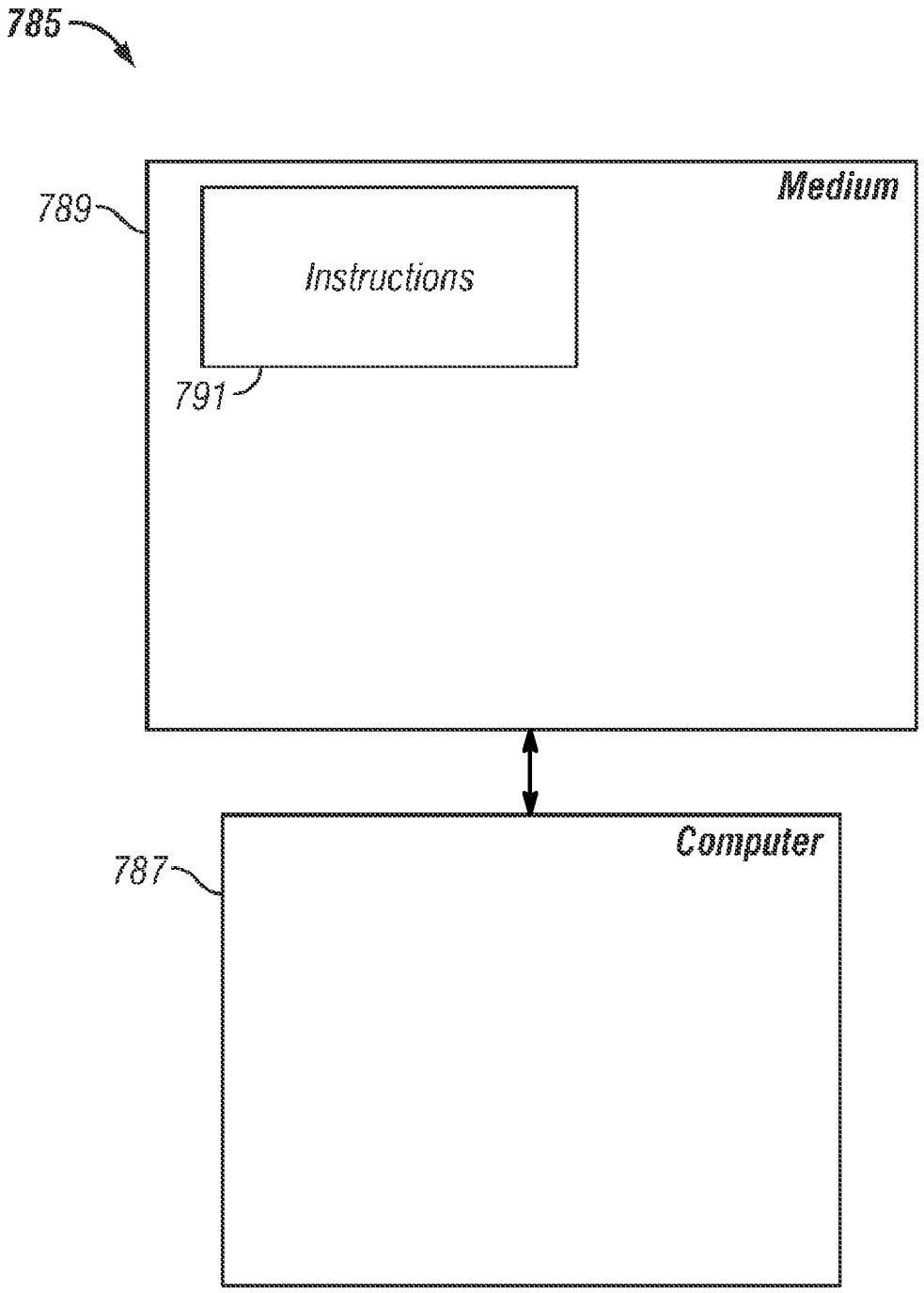
FIG. 7 is a block diagram of an article according to various embodiments of the invention.

For example, FIG. 7 is a block diagram of an article 785 of manufacture according to various embodiments, such as a computer, a memory system, a magnetic or optical disk, or some other storage device. The article 785 may include a processor 787 coupled to a machine-accessible medium such as a memory 789 (e.g., removable storage media, as well as any memory including an electrical, optical, or electromagnetic conductor) having associated information 791 (e.g., computer program instructions and/or data), which when accessed, results in a machine (e.g., the processor 787) performing any actions described with respect to the fluid behaviors of FIG. 1, the apparatus of FIG. 2, the systems of FIGS. 3 and 4, or the methods of FIGS. 5 and 6.

Using the apparatus, systems, and methods disclosed herein may provide a more accurate determination of reservoir fluid sample contamination using formation evaluation tools, by capturing fluid samples that more closely represent the actual composition of the fluid in the reservoir. The sample captured may have less contamination, and be obtained earlier in time. This combination can significantly reduce risk to the operation/exploration company while at the same time controlling time-related costs.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a fluid sampling device to obtain a plurality of formation fluid samples from a formation adjacent to a wellbore;

a pressure measurement device to measure sample saturation pressure of each of the plurality of formation fluid samples; and a processor to map values of each measured sample saturation pressure to an amount of contaminant in the respective obtained formation fluid sample and to determine a predicted ultimate formation fluid saturation pressure based on multiple measurements of the sample saturation pressure using the mapped values.

2. The apparatus of claim 1, wherein the pressure measurement device comprises:

a bubble point sensor to provide a bubble point of at least one of the plurality of formation fluid samples.

3. The apparatus of claim 1, wherein the pressure measurement device comprises:

a compressibility sensor to provide a compressibility of at least one of the plurality of formation fluid samples.

4. The apparatus of claim 1, wherein the pressure measurement device comprises:

a speed of sound sensor to provide a speed of sound in at least one of the plurality of formation fluid samples.

5. The apparatus of claim 1, wherein the pressure measurement device comprises:

an ultrasonic transducer to provide a cavitation pressure of at least one of the plurality of formation fluid samples.

6. The apparatus of claim 1, wherein the pressure measurement device comprises:

a viscosity sensor to provide a viscosity of at least one of the plurality of formation fluid samples.

7. The apparatus of claim 1, wherein the pressure measurement device comprises:

an optical density sensor to provide an optical density of at least one of the plurality of formation fluid samples.

8. A system, comprising:

a downhole tool; and an apparatus at least partially housed by the downhole tool, the apparatus to provide a predicted ultimate saturation pressure of a formation fluid sample, the apparatus comprising a fluid sampling device to obtain a plurality of formation fluid samples from a formation adjacent to a wellbore, a pressure measurement device to measure sample saturation pressure of each of the plurality of formation fluid samples, and a processor to map values of each measured sample saturation pressure to an amount of contaminant in the respective obtained formation fluid sample and to determine the predicted ultimate formation fluid saturation pressure based on multiple measurements of the sample saturation pressure using the mapped values.

9. The system of claim 8, wherein the downhole tool comprises one of a wireline tool or a measurement while drilling tool.

10. The system of claim 8, comprising:

a bulk density sensor to provide a bulk density measurement to be correlated with the sample saturation pressure to verify the predicted ultimate formation fluid saturation pressure.

11. The system of claim 8, comprising:

a viscosity sensor to provide a viscosity measurement to be correlated with the sample saturation pressure to verify the predicted ultimate formation fluid saturation pressure.

12. A method, comprising:

obtaining, using a fluid sampling device, a formation fluid sample from a formation adjacent to a wellbore disposed in a reservoir;

determining a sample saturation pressure of the formation fluid sample using a pressure measurement device and storing the sample saturation pressure in a memory;

repeating, under the control of a processor, the obtaining of the formation fluid sample and the determining of the sample saturation pressure over a selected time period or number of samples, and the storing of the sample saturation pressure;

mapping values of each determined sample saturation pressure to an amount of contaminant in the respective obtained formation fluid sample, using the processor to perform the mapping after retrieving values of determined sample saturation pressures stored in the memory; and determining a predicted ultimate formation fluid saturation pressure by the processor using the mapped values.

13. The method of claim 12, wherein determining the predicted ultimate formation fluid saturation pressure comprises:

determining the predicted ultimate formation fluid saturation pressure based on a substantially unchanged value of the sample saturation pressure.

14. The method of claim 12, comprising:

determining a contaminant percent-by-weight or volume of the formation fluid sample based on the sample saturation pressure.

15. The method of claim 12, wherein determining the predicted ultimate formation fluid saturation pressure comprises:

determining the predicted ultimate formation fluid saturation pressure based on subsequent values of the sample saturation pressure predicted as being less than or equal to a pressure of the reservoir.

16. The method of claim 12, comprising:

determining a predicted percent-by-weight contamination percentage of the formation fluid sample as a substantially linear approximation of at least three serial measurements of the sample saturation pressure.

17. The method of claim 12, comprising:

correlating the sample saturation pressure with a viscosity measurement to verify the predicted ultimate formation fluid saturation pressure.

18. The method of claim 12, wherein repeating the obtaining of the formation fluid sample and the determining of the sample saturation pressure comprises:

obtaining a subsequent formation fluid sample when the sample saturation pressure is greater than a pressure of the reservoir; and determining the sample saturation pressure of the subsequent formation fluid sample.

19. The method of claim 12, wherein determining the sample saturation pressure comprises:

determining a bubble point of the formation fluid sample; and deriving the sample saturation pressure from the bubble point.

20. The method of claim 19, wherein determining the bubble point comprises:

determining the bubble point as an inflection point of repeated measurements of compressibility of the formation fluid sample.

21. The method of claim 19, wherein determining the bubble point comprises:

determining the bubble point as a discontinuity in repeated measurements of speed of sound in the formation fluid sample.

22. The method of claim 19, wherein determining the bubble point comprises:

determining the bubble point as an ultrasonic cavitation pressure.

23. The method of claim 19, wherein determining the bubble point comprises:

determining the bubble point as a discontinuity in repeated measurements of viscosity of the formation fluid sample.

24. An article including a non-transitory machine-accessible medium having instructions stored therein, wherein the instructions, when accessed, result in a machine performing:

obtaining, using a fluid sampling device, a formation fluid sample from a formation adjacent to a wellbore disposed in a reservoir;

determining a sample saturation pressure of the formation fluid sample using a pressure measurement device and storing the sample saturation pressure in a memory;

repeating, under the control of a processor, the obtaining of the formation fluid sample and the determining of the sample saturation pressure over a selected time period or number of samples, and the storing of the sample saturation pressure;

mapping values of each determined sample saturation pressure to an amount of contaminant in the respective obtained formation fluid sample, using the processor to perform the mapping after retrieving values of determined sample saturation pressures stored in the memory; and determining a predicted ultimate formation fluid saturation pressure by the processor using the mapped values.

25. The article of claim 24, wherein obtaining the formation fluid sample comprises:

terminating the repeating to perform contaminant correlation analysis of the formation fluid sample after the predicted ultimate formation fluid saturation pressure is determined.

26. The article of claim 24, wherein the instructions, when accessed, result in the machine performing:

correlating the sample saturation pressure and differentials of the sample saturation pressure with a density of the formation fluid sample to verify the predicted ultimate formation fluid saturation pressure.

* * * * *